US005458066A

United States Patent [19]

Ishida et al.

[11] Patent Number: 5,458,066

[45] Date of Patent: Oct. 17, 1995

[54] VEHICLE BODY AND ASSEMBLING METHOD FOR THE SAME

[75] Inventors: Takeshi Ishida; Hiroyuki Onishi, both of Kobe, Japan

[73] Assignee: Kawasaki Jukogyo Kabushiki Kaisha, Hyogo, Japan

[21] Appl. No.: 202,681

[22] Filed: Feb. 25, 1994

Related U.S. Application Data

[63] Continuation of Ser. No. 987,805, Dec. 9, 1992, abandoned.

[51] Int. Cl.[6] ..... B61D 17/00

[52] U.S. Cl. ..... 105/401; 105/397

[58] Field of Search ..... 105/396, 397, 105/401, 404, 409

[56] References Cited

U.S. PATENT DOCUMENTS

| | | | |
|---|---|---|---|
| 709,894 | 9/1902 | Farrell | 105/401 |
| 877,474 | 1/1908 | Ostrander | 105/401 |
| 3,252,430 | 5/1966 | Eckhardt et al. | 105/397 |
| 3,461,819 | 8/1969 | Eggert | 105/401 |
| 3,794,374 | 6/1972 | Manning | 296/28 A |
| 3,881,765 | 5/1975 | Carra et al. | 105/401 |
| 4,221,426 | 9/1980 | Wardill | 105/397 |
| 4,469,369 | 9/1984 | Belik et al. | 296/197 |
| 5,140,913 | 8/1992 | Takeichi et al. | 105/397 |

FOREIGN PATENT DOCUMENTS

| | | | |
|---|---|---|---|
| 1129083 | 1/1957 | France | 105/396 |
| 1187592 | 9/1959 | France | 105/401 |
| 0640513 | 12/1936 | Germany | 105/397 |
| 1900649 | 9/1964 | Germany . | |
| 2031546 | 9/1971 | Germany | 105/401 |
| 0145249 | 12/1980 | Germany | 105/401 |
| 0478172 | 2/1953 | Italy | 105/401 |
| 60-13860 | 4/1985 | Japan . | |

OTHER PUBLICATIONS

K. K. Railway System Research, Jul. 7, 1986, pp. 149–163.

*Primary Examiner*—Mark T. Le
*Attorney, Agent, or Firm*—Oliff & Berridge

[57] ABSTRACT

A body of a vehicle which is easy to assemble without the necessity of a spacious location and is effective in mass production and an assembling method for the body of a vehicle. The body comprises a plurality of sectors coupled in circumferential directions to each other to make up a plurality of sections each having a substantially tubular hollow configuration, the sections being coupled in a longitudinal direction to make up the body of the vehicle. In manufacture, the sectors are produced first and then coupled in circumferential directions to form the plurality of sections. Finally, the sections are coupled in a longitudinal direction to make up the body of the vehicle.

11 Claims, 6 Drawing Sheets

VEHICLE BODY AND ASSEMBLING METHOD FOR THE SAME

This is a Continuation of application Ser. No. 07/987,805 filed Dec. 9, 1992, now abandoned.

BACKGROUND OF THE INVENTION

1. Field of the Invention

This invention relates to a body of a vehicle wherein the body has a substantially same sectional shape along the overall length thereof and has a comparatively great length such as a railway rolling stock and a method of assembling the body.

2. Description of the Related Art

One of methods of manufacturing a body of a vehicle having a comparatively great length such as a railway rolling stock which have conventionally been employed popularly is disclosed in Hiroshi Matsuzawa, "Introduction to Passenger-Carrying Car Engineering", Kabushiki Kaisha Railway System Research, Jul. 7, 1986, pp. 152–158 or Japanese Patent Publication Application No. 60-13860. According to the method, various components of a body of a vehicle including an underframe, a pair of left and right side framings, a pair of front and rear end framings and a roof framing are produced for one vehicle for each vehicle type, and then, the components are coupled as different sides of a hexahedron into a unitary member to construct a body of a vehicle.

With the prior art manufacturing method, however, since the different elements of the hexahedron structure are produced for each vehicle, when a body which is, for example, partially different in design is to be manufactured, related components must be produced as separated members. Accordingly, the enhancement of the productivity in mass production cannot be achieved readily.

Further, while various jigs are used for positioning or keeping of postures of various elements when they are to be coupled to each other, since the components except the front and rear end framings extend over the overall length of the body and besides have planar profiles, they are liable to bend. Accordingly, the jigs for keeping the postures must have large sizes corresponding to the length of the body. Further, naturally a spacious operation location is required for both of a producing operation for each component and a coupling operation for the entire body. Further, when a body which is different in structure even at part thereof is to be manufactured, related jigs must be reset, and accordingly, the manufacturing operation must be interrupted for the re-setting.

SUMMARY OF THE INVENTION

It is an object of the present invention to provide a body of a vehicle which is easy to assemble without the necessity of a spacious location and is effective in mass production and an assembling method for the body of a vehicle.

In order to attain the object, according to one aspect of the present invention, there is provided an assembling method for a body of a vehicle, which comprises the steps of producing sectors from which are to be formed a plurality of sections which each has a substantially tubular hollow profile and are to be assembled to make up a body of a vehicle, coupling the sectors in circumferential directions to form the plurality of sections, and coupling the sections in a longitudinal direction to make up the body of the vehicle.

Preferably, at the sector coupling step, the sectors for each of the plurality of sections are coupled in a condition wherein one of them is displaced from the other of them in the longitudinal direction of the vehicle. When a plurality of vehicles of different types which individually include common sections and original sections are to be manufactured, at the sector producing step, sectors are produced from which are to formed a plurality of sections which make up, when assembled, bodies of the vehicles, and at the sector coupling step, those of the sectors which make up, when coupled, common and original sections of a vehicle of one of the different types are coupled to form the common and original sections.

Thus, in the assembling method, sectors are produced from which are to be formed a plurality of sections which each has a substantially tubular hollow profile and are to be assembled to make up a body of a vehicle. Accordingly, each sector is an element obtained by dividing the body of the vehicle into a plurality of pieces in the longitudinal direction and the circumferential direction. After the sectors are produced, they are coupled in circumferential directions to form a plurality of sections each having a substantially tubular hollow section. In this instance, since each sector has a longitudinal length equal to a fraction of the overall length of the vehicle, the sectors can be handled readily and assembling jigs for them have corresponding small sizes. Further, since also the longitudinal length of each section is small, assembly for the sections can be performed by operations which are performed parallelly, and accordingly, the loss in time or the waiting time is reduced. Besides, a spacing required for assembly of sectors is small. In addition, since the numbers of sectors having the same configurations are great, an effect of quantity arises and the productivity is enhanced.

After the sections are completed, they are arranged in the longitudinal direction of the vehicle and coupled to each other. Since each of the sections has a small longitudinal length and besides has a three-dimensional configuration, it can keep its posture by itself, and accordingly, coupling jigs for the sections are only required to keep the sections to be coupled to each other at respective predetermined positions and accordingly have comparatively small sizes without being influenced by the sizes of the sections or the coupling positions.

When the sectors for each of the plurality of sections are coupled in a condition wherein one of them is displaced from the others of them in the longitudinal direction of the vehicle, an end portion of the sector which extends farther than the other sectors is resiliently displaceable a little. Such resilient displacement absorbs, upon coupling to an adjacent section, errors of the sections thereby to facilitate positioning of the sections prior to a coupling operation.

When a plurality of vehicles of different types which individually include common sections and original sections are to be manufactured, sections which are common to the vehicles and sections which are original to the vehicles are produced suitably and then assembled in suitable combinations to manufacture bodies of the vehicles.

According to another aspect of the present invention, there is provided an assembling method for a body of a vehicle, which comprises the steps of producing sectors from which are to be formed a plurality of sections which each has a substantially tubular hollow profile and are to be assembled to make up a body of a vehicle, coupling part of the sectors in circumferential directions at two locations spaced away from each other to produce two sections which are to be spaced away from each other in a body of a vehicle to be manufactured, and coupling the two sections to each other with those of the sectors which are to form an intermediate section or sections to be positioned intermediately between the two sections, and coupling the remaining sectors to those sectors for the section or sections. Preferably, at the sector coupling step and the section coupling step, the sectors for each of the sections are coupled in a condition wherein one of them is displaced from the other of them in the longitudinal direction of the vehicle. When a plurality of vehicles of different types which individually include common sections and original sections are to be manufactured, at the sector producing step, sectors are produced from which are to be formed a plurality of sections which make up, when assembled, bodies of the vehicles, and then at the sector coupling step, those of the sectors which make up, when coupled, original sections of a vehicle of one of the different types are coupled to form the original sections, and finally at the section coupling step, those of the sectors which are to form an intermediate section or sections which include a common section or sections and then the remaining sectors to those sectors for the section or sections to make up the vehicle of the one of the different types.

Thus, in the assembling method, similarly as in the preceding assembling method, sectors are produced from which are formed a plurality of sections which each has a substantially tubular hollow profile and are to be assembled to make up a body of a vehicle. After the sectors are produced, some of the sectors are coupled in circumferential directions at two locations spaced away from each other to produce two sections which are to be spaced away from each other in a body of a vehicle to be manufactured, and subsequently, the two sections are coupled to each other with those of the sectors which are to form an intermediate section or sections to be positioned intermediately between the two sections and the remaining sectors are finally coupled to those sectors for the section or sections. In this instance, since each sector has a longitudinal length equal to a fraction of the overall length of the vehicle, the sectors can be handled readily and assembling jigs for them have corresponding small sizes. Further, since also the longitudinal length of each section is small, assembly for the sections can be performed by operations which are performed parallelly, and accordingly, the loss in time or the waiting time is reduced. Besides, a spacing required for assembly of sectors is small. In addition, since the numbers of sectors having the same configurations are great, an effect of quantity arises and the productivity is enhanced. Furthermore, since each of the sections has a small longitudinal length and besides has a three-dimensional configuration, it can keep its posture by itself, and accordingly, coupling jigs for the sections are only required to keep the sections to be coupled to each other at respective predetermined positions and accordingly have comparatively small sizes without being influenced by the sizes of the sections or the coupling positions. In addition, since the two sections are produced first and then the intermediate section or sections are produced between the two section, the body of the vehicle can be manufactured in a comparatively small spacing and special assembling jigs are not required.

When the sectors for each of the plurality of sections are coupled in a condition wherein one of them is displaced from the others of them in the longitudinal direction of the vehicle, an end portion of the sector which extends farther than the other sectors is resiliently displaceable a little. Such resilient displacement absorbs, upon coupling to an adjacent section, errors of the sections thereby to facilitate positioning of the sections prior to a coupling operation.

When a plurality of vehicles of different types which individually include common sections and original sections are to be manufactured, some of the sectors are assembled in circumferential directions at two locations spaced away from each other to produce two sections which are to be spaced away from each other in each of bodies of vehicles to be manufactured, and then the two sections thus produced are coupled to each other with those of the sectors which are to form an intermediate section of sections to be positioned intermediately between the two sections, whereafter the remaining sectors are coupled to those sectors for the section or sections. Thus, the bodies of the vehicles of the different types can be assembled by suitable combination of the common sections and original sections for the two sections and the intermediate section or sections.

According to a further aspect of the present invention, by any of the manufacturing methods described above, a body of a vehicle is manufactured which comprises a plurality of sectors which are coupled in circumferential directions to each other to make up a plurality of sections each having a substantially tubular hollow configuration, the sections being coupled in a longitudinal direction to make up the body of the vehicle. Preferably, the sectors for each of the plurality of sections are coupled in a condition wherein one of them is displaced from the other of them in the longitudinal direction of the vehicle.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
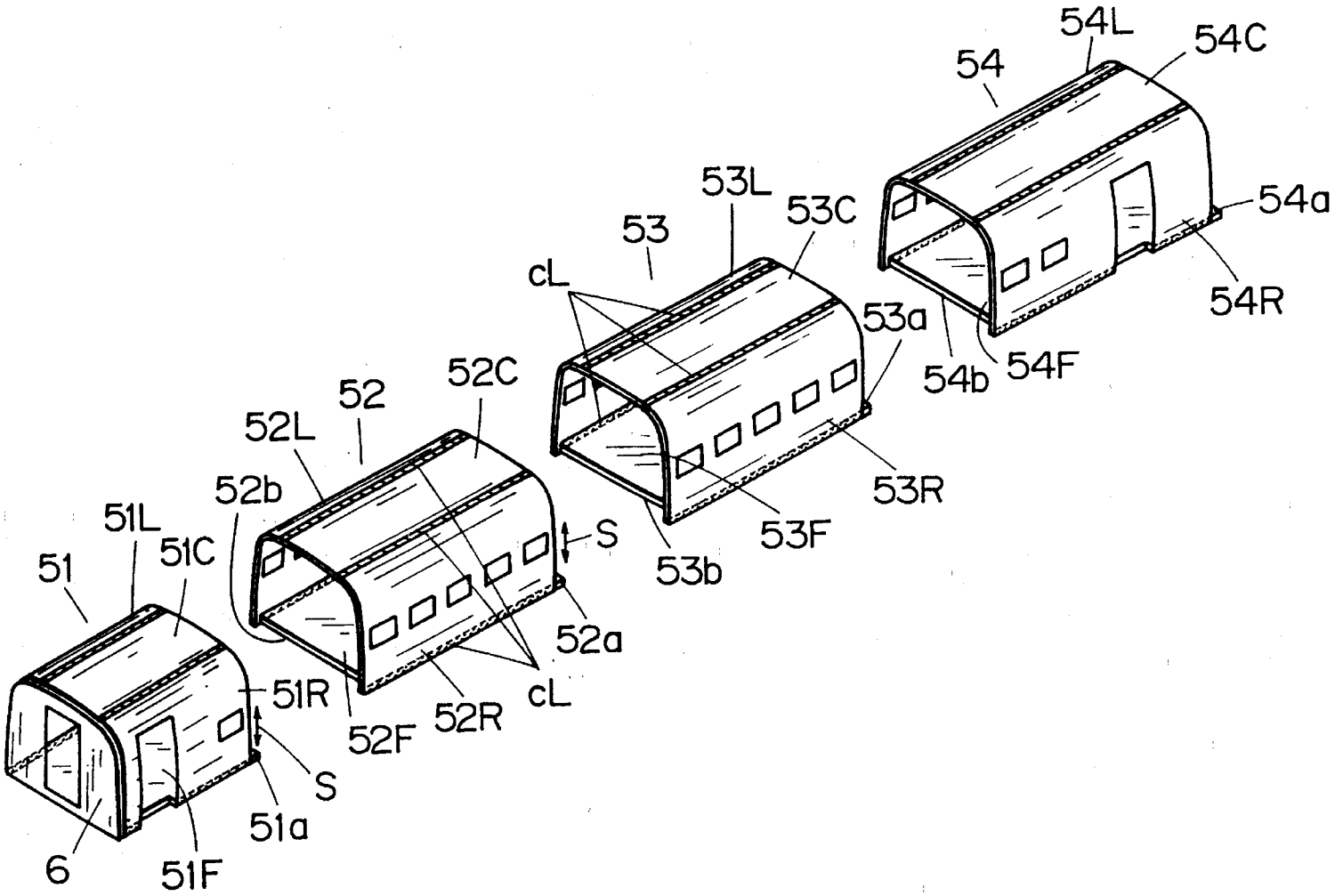
FIG. 1 is an exploded perspective view illustrating an assembling method for a body of a vehicle according to the present invention and showing the body of the vehicle divided in several sections.
Figure 2:
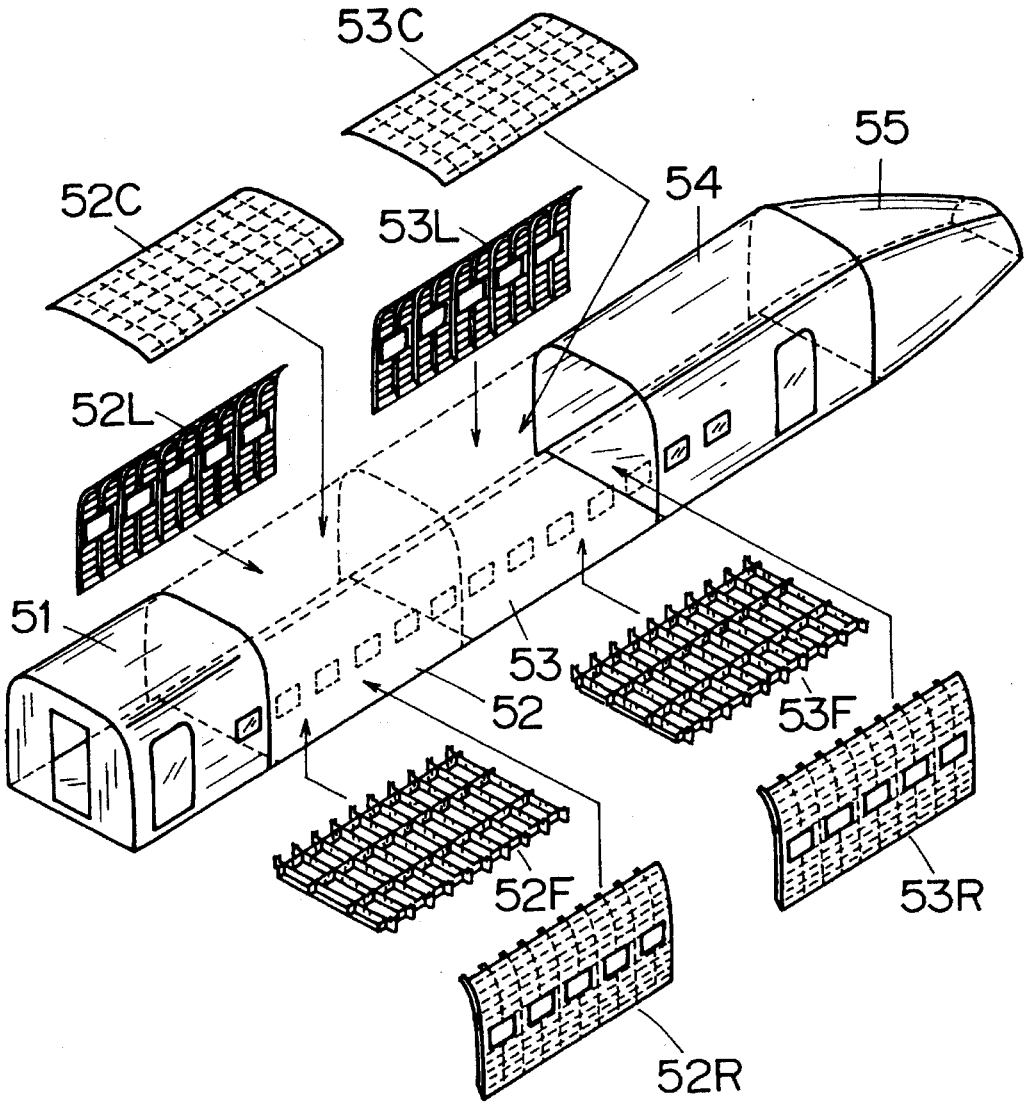
FIG. 2 is an exploded perspective view showing exemplary construction of the sections shown in FIG. 1.

Referring first to FIGS. 1 and 2, there is shown a body of a vehicle to which the present invention is applied. The vehicle body shown includes four sections 51 to 54 and a front (or rear) end body section 55. The four sections 51 to 54 and the end body section 55 correspond to different elements formed by cutting the vehicle body along the overall length, and each of the four sections 51 to 54 has a substantially tubular hollow profile as seen from FIG. 1. Several suffixes are applied to some of the reference numerals 51 to and the suffixes R and L applied to any of the reference numerals 51 to 54 denote right and left side framing sectors of the section 51 to 54, respectively, while the suffix F denotes a floor framing sector and C denotes a roof framing sector.

Each of the sections 51 to 54 is generally constituted from four elements having the suffixes R, L, F and C. For example, the intermediate section 52 is formed by coupling a floor framing section 52F, a right side framing sector 52R, a roof framing sector 52C and a left side framing sector 52L, which are individually assembled as such partial panels as shown in FIG. 2, in a circumferential direction along individual longitudinal coupling lines CL indicated by hatching lines in FIG. 1. The section 51 at the other end of the vehicle body remote from the front end body section 55 has an end framing 6 additionally coupled thereto.

Each section is coupled, after it is set in position, to an adjacent section along a circumferential direction indicated by an arrow mark S in FIG. 1 to form a body of a vehicle. It is to be noted that the front end section 55 is assembled separately into a tubular hollow framing and coupled to the remaining sections 51 to 54 after they are coupled to each other.

The sections 51 to 54 may be coupled to each other beginning with one end side of the vehicle body or otherwise at random at any suitable location. However, generally a tact manufacturing system wherein the position of the body is fed successively for each step from the end of the body is suitably employed.

In this instance, in the rear end section 51, for example, the floor framing sector 51F is made a little longer than the other sectors 51L, 51R and 51C of the rear end section 51 so as to form a projection or extension 51*a*. Further, in each of the other sections 52 to 55, the floor framing sector F is displaced by a distance equal to the length of the projection 51*a* with respect to the other sectors of the section 52 to 55. In short, a recessed portion 52*b*, 53*b*, or 54*b* is formed adjacent the rear end section 51 in the floor of each of the sections 52 to 54 while a projection 52*a*, 53*a* or 54*a* is formed on the floor of each section 52 to 54 remote from the rear end section 51. According to the construction, the projections 51*a*, 52*a*, 53*a* and 54*a* of the floor framing sectors 51F to 54F make free end extensions extending from the ends of the sectors and allowing a little displacement or deformation thereof. Such deformation provides tolerances of the projections 51*a* to 54*a* of the sections 51 to 54 with regard to the recessed portions 52*b*, 53*b*, 54*b* and 55*b* of the counterpart sections 52 to 55, respectively, and thus makes a positioning operation between each two adjacent sections 51 and 52, 52 and 53, and 53 and 54 prior to coupling of them. Naturally, however, if the accuracy in finish of the individual sections is so high that there is no trouble in positioning between the sections, then the floor framing sectors F need not be displaced in this manner.

Figure 3A:
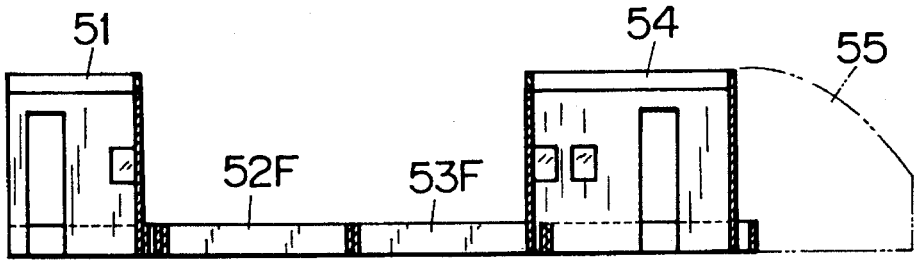
FIGS. 3*a* to 3*d* are schematic side elevational views illustrating another assembling method for a body of a vehicle according to the present invention.
Figure 3B:
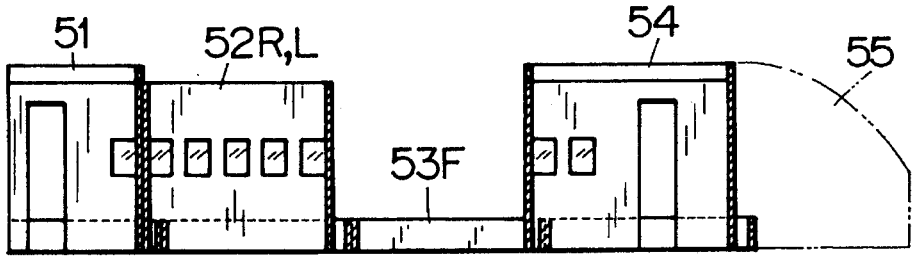
Figure 3C:
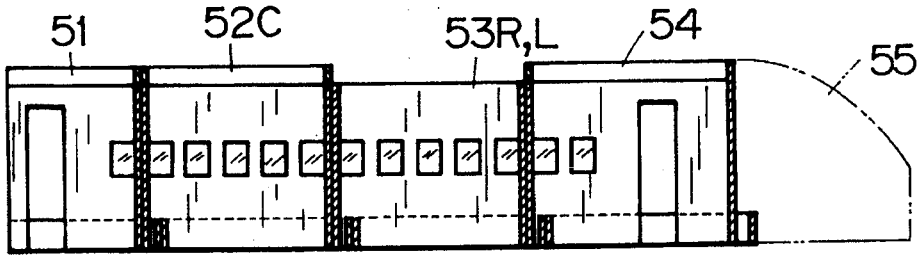
Figure 3D:
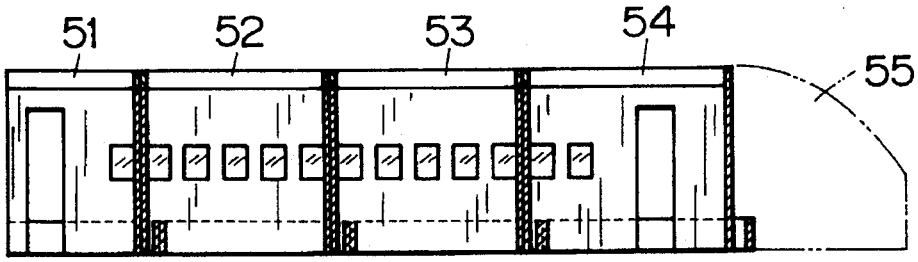
Figure 4A:
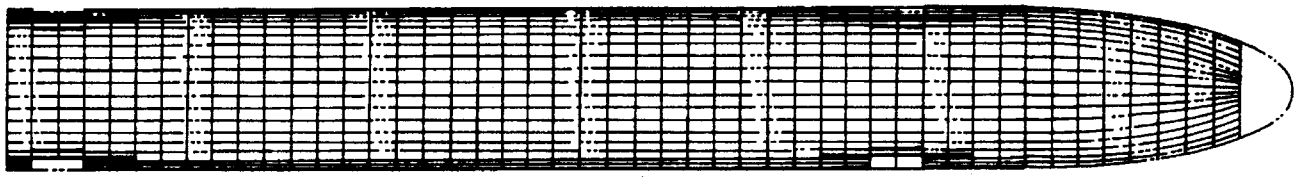
FIGS. 4*a* to 4*d* are schematic views showing exemplary structure of a body of a vehicle according to the present invention.
Figure 4B:
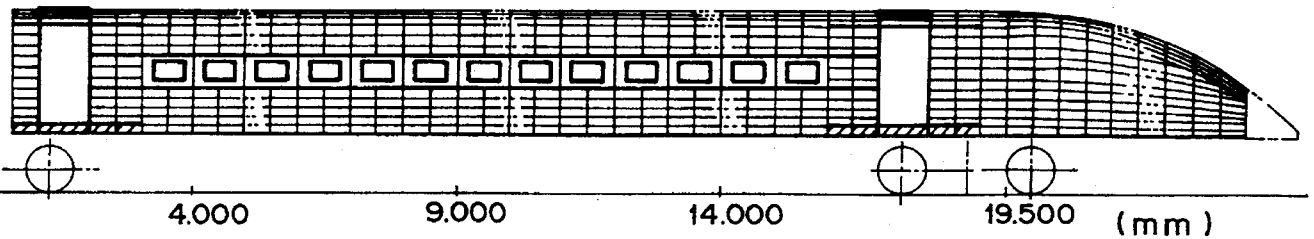
Figure 4C:
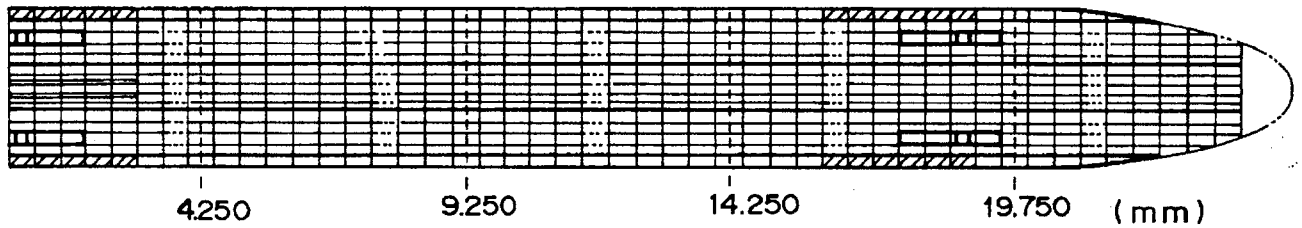
Figure 4D:
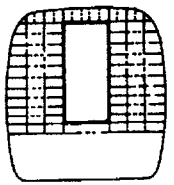

Referring now to FIGS. 3*a* to 3*d*, there is shown a second embodiment of the present invention. Each section has similar construction to those of the embodiment shown in FIGS. 1 and 2. In the present embodiment, however, only the sections 51 and 54 at the rear end and adjacent the front end of the vehicle are individually assembled as sections and placed at predetermined positions as shown in FIG. 3*a*, and only part of the intermediate sections 52 and 53, for example, the floor framing sectors 52F and 53F, are coupled first. Then, the side framing sectors 52R and 52L of the second section 52 are erected uprightly on the opposite sides of the floor framing sector 52F as shown in FIG. 3*b*. Subsequently, the roof framing sector 52C is coupled to complete the section 52, and then, the side framing sectors 53R and 53L of the next section 53 are coupled as shown in FIG. 3*c*. Then, the roof framing sector 53C is attached as shown in FIG. 3*d*, and finally the head section 55 is attached, thereby completing the body.

The method illustrated in FIGS. 3*a* to 3*d* is suitable to a case wherein there is a restriction in location and the tact manufacturing method cannot be employed. While the present method is inferior in production capacity comparing with the tact manufacturing method, since the sections 51 and 54 assembled accurately are present at the front and rear ends of the vehicle, the intermediate sections 52 and 53 can be assembled in order with reference to the opposite front and rear sides thereof. Accordingly, special jigs for assembly and coupling are unnecessary.

FIGS. 4*a* to 4*d* show an exemplary construction of a body of a vehicle according to the present invention. Referring to FIGS. 4*a* to 4*d*, an alternate long and two short dashes line in the longitudinal direction of the body denotes a longitudinal continuous member, and a thick solid line denotes a reinforcing longitudinal continuous member. A hatching line portion is a particularly reinforced gateway opening, and also a portion around each window opening is reinforced. Coupling portions of the sections 51 to 54 are located at positions at distances of 4,000, 9,000, 14,000 and 19,500 mm from the center of the last truck at the rear end of the body, and coupling portions of the floors of the sections 51 to 54 are located at positions at distances of 4,250, 9,250, 14,250 and 19,750 mm which are displaced by 250 mm from the positions of the coupling portions of the sections 51 to 54, respectively.

Figure 5A:
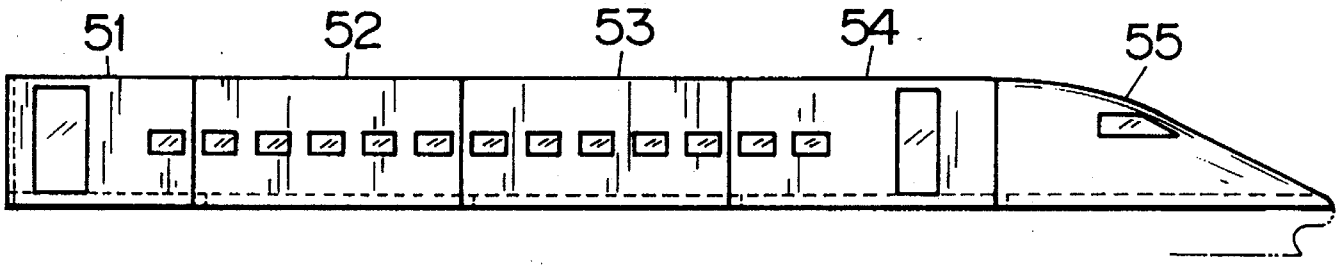
FIGS. 5*a* to 5*d* are schematic side elevational views illustrating relationships among various vehicle bodies of different types and various sections constituting the vehicle bodies.
Figure 5B:
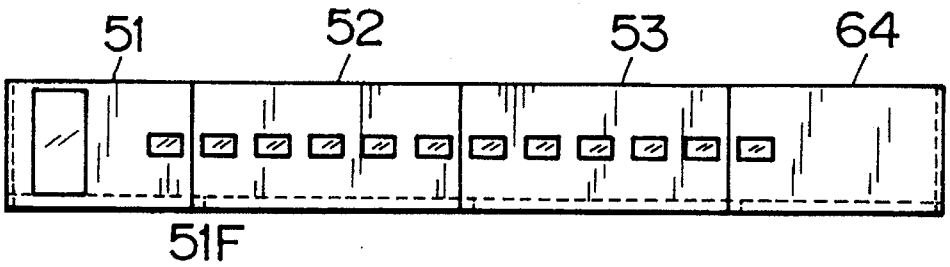
Figure 5C:
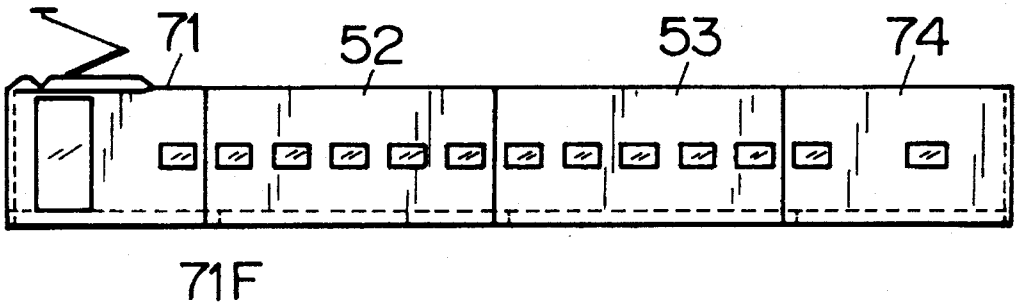
Figure 5D:
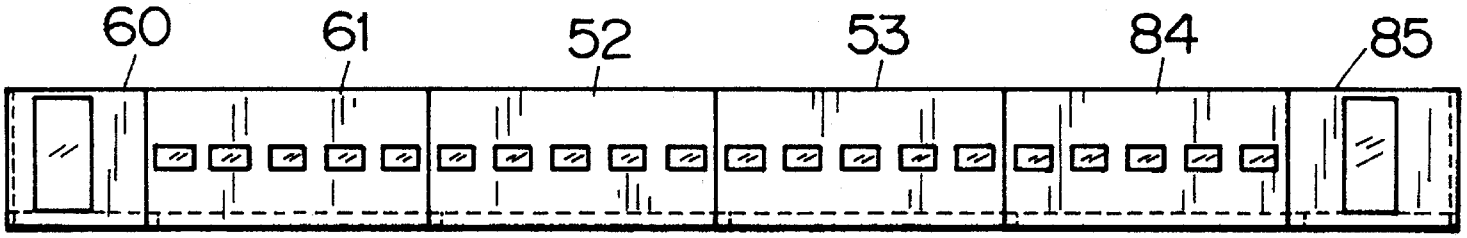

FIGS. 5*a* to 5*d* show several examples of a railway rolling stock consisting of various sections. The railway rolling stock shown in FIG. 5*a* is formed as a head (leading end) vehicle (or as a trailing end vehicle) of the type similar to that shown in FIGS. 1 and 2 and is constituted from sections 51 to 55. Meanwhile, FIG. 5*b* shows an intermediate vehicle which is constituted from sections 51 to 53, which are common to those of the head vehicle shown in FIG. 5*a*, and a section 64 which is original and has a toilet provided therein. FIG. 5*c* shows another intermediate vehicle which is similar to the intermediate vehicle shown in FIG. 5*b* but includes, as original sections, a section 71 having a pantograph provided thereon and another section 74 having no toilet provided thereon, in place of the sections 51 and 64, respectively. It is to be noted that each of the bodies shown in FIGS. 5*a* to 5*c* is an articulated car, and a body connected to it is of the type having a truck. Meanwhile, FIG. 5*d* shows a further intermediate vehicle which is of a type different from those of FIGS. 5*b* and 5*c* in that it does not have an articulated structure and has original trucks at leading and trailing end portions of the body thereof and consequently it is longer in overall length as much than the intermediate vehicles of FIGS. 5*b* and 5*c*. The intermediate vehicle shown in FIG. 5*d* includes two front and two rear sections 60, 61 and 84, 85 as original sections of the body thereof.

As can be seen from the foregoing description, the sections 52 and 53 are common to the vehicles of all of the types described above. On the other hand, while, for example, the sections 51 and 71 are generally different in configuration from each other, the floor framing sectors 51F and 71F of the components thereof are common to each other and accordingly can be assembled using same jigs. Similarly, the sections 64 and 74 are common to each other with regard to the floor framing sections 64F and 74F and the roof framing sectors 64C and 74C, respectively. Table 1 below shows the relationships among the vehicles described above.

TABLE 1

| Section Sector | i0 | i1 | 52 53 | i4 | i5 |
|---|---|---|---|---|---|
| Roof Framing | 1 kind i = 6 | 3 kinds i = 5,6,7 | 1 kind Common to All | 3 kinds i = 5, 6 (7), 8 | 2 kinds i = 5,8 |
| R or L Side Framing | 1 kind i = 6 | 2 kinds i = 5 (7), 6 | 1 kind Common to All | 4 kinds i = 5,6, 7,8 | 2 kinds i = 5,8 |
| Floor Framing | 1 kind i = 6 | 2 kinds i = 5 (7), 6 | 1 kind Common to All | 2 kinds i = 5 (8), 6 (7) | 2 kinds i = 5,8 |
| End Framing | | | 1 kind Common to All | | |

Having now fully described the invention, it will be apparent to one of ordinary skill in the art that many changes and modifications can be made thereto without departing from the spirit and scope of the invention as set forth herein.

What is claimed is:

1. An assembling method for a body of a vehicle, comprising the steps of:

forming vehicle body sectors, each sector defining one of a plurality of divisions of the body of the vehicle in each of a longitudinal direction and a circumferential direction;

after forming the vehicle body sectors, coupling a plurality of said vehicle body sectors in the circumferential direction to form a vehicle body section having a substantially tubular profile;

forming at least one additional vehicle body section by repeating the vehicle body sector forming step and the coupling step, each vehicle body section having all of the vehicle body sectors coupled so that longitudinal ends of each of the vehicle body sectors are in alignment except that the longitudinal ends of at least one sector is longitudinally displaced and is not in alignment with the other sectors of said each section; and after coupling the plurality of said vehicle body sectors in the circumferential direction, coupling a plurality of vehicle body sections in the longitudinal direction to form the body of the vehicle without using a chassis to support the vehicle body in the longitudinal direction.

2. The assembling method of claim 1, wherein each of the plurality of vehicle body sections formed in the sector coupling step is one of a common section and an original section, the plurality of sections coupled in said section coupling step forming a plurality of different types of bodies, said common sections common to each of the plurality of different types of bodies and said original sections original to one of the plurality of different types of bodies, wherein the vehicle body section coupling step comprises coupling two original sections, two common sections or one common section and one original section.

3. An assembling method for a body of a vehicle, comprising the steps of:

forming vehicle body sectors, each sector defining one of a plurality of divisions of the body of the vehicle in each of a longitudinal direction and a circumferential direction;

after forming the vehicle body sectors, coupling a plurality of said vehicle body sectors in the circumferential direction to form a vehicle body section having a substantially tubular profile;

forming at least one additional vehicle body section by repeating the vehicle body sector forming step and the coupling step, each vehicle body section having all of the vehicle body sectors coupled so that longitudinal ends of each of the vehicle body sectors are in alignment except that the longitudinal ends of at least one sector is longitudinally displaced and is not in alignment with the other sectors of said each section; and after coupling the plurality of said vehicle body sectors in the circumferential direction, coupling a plurality of vehicle body sections in the longitudinal direction to form the body of the vehicle.

4. An assembling method for a body of a vehicle, comprising the steps of:

forming vehicle body sectors, each sector defining one of a plurality of divisions of the vehicle body, the plurality of divisions formed in each of a longitudinal direction and a circumferential direction of the body of the vehicle;

after forming the vehicle body sectors, coupling a plurality of said vehicle body sectors in the circumferential direction to form a spaced section, each spaced section having a substantially tubular profile;

forming at least one additional spaced section by repeating the vehicle body sector forming step and the coupling step;

after coupling the plurality of said vehicle body sectors in the circumferential direction, coupling a pair of said spaced sections together using at least one intermediate sector without using a chassis to support the vehicle body in the longitudinal direction, the at least one intermediate sector positioned between said pair of said spaced sections; and coupling additional sectors to said at least one intermediate sector to form at least one intermediate section between said pair of said spaced sections.

5. The assembling method of claim 4, wherein each of the plurality of vehicle body sections formed in the sector coupling step is one of a common section and an original section, the plurality of sections coupled in said section coupling step forming a plurality of different types of bodies, said common sections common to each of the plurality of different types of bodies and said original sections original to one of the plurality of different types of bodies, wherein said pair of said spaced sections comprises two original sections, two common sections or one common section and one original section.

6. An assembling method for a body of a vehicle, comprising the steps of:

forming vehicle body sectors, each sector defining one of a plurality of divisions of the body of the vehicle in each of a longitudinal direction and a circumferential direction;

after forming the vehicle body sectors, coupling a plurality of said vehicle body sectors in the circumferential direction to form a spaced section, each spaced section having a substantially tubular profile;

forming at least one additional spaced section by repeating the vehicle body sector forming step and the coupling step;

after coupling the plurality of said vehicle body sectors in the circumferential direction, coupling a pair of said spaced sections together using at least one intermediate sector, the at least one intermediate sector positioned between said pair of said spaced sections; and coupling additional sectors to said at least one intermediate sector to form at least one intermediate section between said pair of said spaced sections, wherein each section of said pair of said spaced sections and said at least one intermediate section has all of the vehicle body sectors coupled so that longitudinal ends of each of the vehicle body sectors are in alignment except that the longitudinal ends of at least one sector is longitudinally displaced and is not in alignment with the other sectors of said each section of said pair of said spaced sections and said at least one intermediate section.

7. A body of a vehicle comprising:

a plurality of separate distinctive sections, each separate distinctive section formed from a plurality of sectors to have a substantially tubular profile, the plurality of sectors circumferentially coupled together to have the substantially tubular profile, each separate distinctive section having all of the sectors coupled so that longitudinal ends of each of the sectors are in alignment except that the longitudinal ends of at least one sector is longitudinally displaced and is not in alignment with the other sectors of said each separate distinctive section; and each one of the plurality of sectors comprising one of a plurality of divisions of the vehicle body, the plurality of divisions formed in each of a longitudinal direction and a circumferential direction of the body of the vehicle, wherein the plurality of separate distinctive sections are coupled together to form the vehicle body without using a chassis to support the vehicle body in the longitudinal direction.

8. A body of a vehicle comprising:

a plurality of separate distinctive sections, each separate distinctive section formed from a plurality of sectors to have a substantially tubular profile, the plurality of sectors circumferentially coupled together to have the substantially tubular profile; and each one of the plurality of sectors comprising one of a plurality of divisions of the vehicle body, the plurality of divisions formed in each of a longitudinal direction and a circumferential direction of the body of the vehicle, each separate distinctive section having all of the sectors coupled so that longitudinal ends of each of the sectors are in alignment except that the longitudinal ends of at least one sector is longitudinally displaced and is not in alignment with the other sectors of said each separate distinctive section.

9. The assembly method of claim 1, wherein each one of the plurality of sectors consists of one of a floor sector, a side sector and a roof sector.

10. The assembling method of claim 4, wherein each one of the plurality of sectors consists of one of a floor sector, a side sector and a roof sector.

11. The body of a vehicle of claim 7, wherein each one of the plurality of sectors consists of one of a floor sector, a side sector and a roof sector.

* * * * *